US005224842A

United States Patent [19]

Dziorny et al.

[11] Patent Number: 5,224,842

[45] Date of Patent: Jul. 6, 1993

[54] AIR CYCLE MACHINE WITH INTERSTAGE VENTING

[76] Inventors: Paul J. Dziorny, 132 Strawberry La., Manchester, Conn. 06040; Christopher McAuliffe, 18 Kellogg St., Windsor, Conn. 06095

[21] Appl. No.: 819,426

[22] Filed: Jan. 10, 1992

[51] Int. Cl.[5] ..... F04B 17/00

[52] U.S. Cl. ..... 417/406

[58] Field of Search ..... 417/406, 405; 62/401, 62/402

[56] References Cited

U.S. PATENT DOCUMENTS

| | | | |
|---|---|---|---|
| 2,283,176 | 5/1942 | Birmann | 417/406 |
| 2,864,552 | 12/1958 | Anderson | 417/406 |
| 2,973,136 | 2/1961 | Greenwald | 62/402 |
| 3,069,133 | 12/1962 | Swearingen | 417/406 |
| 3,133.425 | 5/1964 | Hänny et al. | 62/402 |
| 3,428,242 | 2/1969 | Rannenberg | 415/180 |
| 3,728,857 | 4/1973 | Nichols | 62/402 |
| 4,086,760 | 5/1978 | Chute | 417/406 |
| 4,312,191 | 1/1982 | Biagini | 62/402 |
| 4,507,939 | 4/1985 | Wieland | 62/402 |
| 4,543,038 | 9/1985 | Kitaguchi | 417/406 |
| 5,113,670 | 5/1992 | McAuliffe et al. | 417/406 |

FOREIGN PATENT DOCUMENTS

| | | | |
|---|---|---|---|
| 918726 | 10/1954 | Fed. Rep. of Germany | 417/406 |
| 3322436 | 1/1985 | Fed. Rep. of Germany | 417/406 |

*Primary Examiner*—Richard A. Bertsch
*Assistant Examiner*—Timothy S. Thorpe
*Attorney, Agent, or Firm*—William W. Habelt

[57] ABSTRACT

An air cycle machine (10) having a plurality of wheels mounted on a common shaft (20) for rotation therewith about a longitudinal axis (12), including a compressor rotor (60) and a turbine rotor (50) mounted to a central portion (20c) of the shaft in back to back relationship, the turbine rotor (50) being operative to extract energy from a flow of compressed air for driving the shaft (20), and the compressor rotor (60), in rotation about the axis. An annular disc-like member (14) is disposed coaxially about the shaft (20) and extends radially outwardly between the turbine rotor (50) and the compressor rotor (60). A venting and sealing assembly (210, 220, 230) is operatively disposed between the shaft (20) and the annular member (14) intermediate the turbine rotor (50) and the compressor rotor (60) whereby a limited flow of compressor outlet air and a limited flow of turbine inlet air are vented to a low pressure region other than the turbine air flow circuit.

3 Claims, 3 Drawing Sheets

AIR CYCLE MACHINE WITH INTERSTAGE VENTING

TECHNICAL FIELD

The present invention relates generally to air conditioning systems for cooling and dehumidifying air for supply to an aircraft cabin or like enclosure and, more particularly, to an air cycle machine having a turbine rotor and a compressor rotor mounted on a common drive shaft in back-to-back relationship.

BACKGROUND ART

Conventional aircraft environmental control systems incorporate an air cycle machine, also referred to as an air cycle cooling machine, for use in cooling and dehumidifying air for supply to the aircraft cabin for occupant comfort. Such air cycle machines may comprise two, three or four wheels disposed at axially spaced intervals along a common shaft, and defining a compressor rotor, a turbine rotor, and one or two additional rotors, for example a fan rotor or an additional turbine rotor or an additional compressor rotor, the turbine or turbines driving both the compressor and the fan. The wheels are supported for rotation about the axis of the shaft on one or more bearing assemblies disposed about the drive shaft. Although the bearing assemblies may be ball bearings or the like, hydrodynamic film bearings, such as gas film foil bearings, are often utilized on state-of-the-art air cycle machines.

Each wheel may comprise only a single rotor, such as, for example, disclosed in commonly assigned U.S. Pat. No. 3,428,242. The three wheel air cycle machine disclosed therein comprises a fan rotor, a turbine rotor and a compressor rotor mounted to a common shaft, with the fan rotor being disposed at one end of the shaft and the turbine and compressor rotors being disposed at the other end of the shaft. The shaft is supported for rotation on a ball bearing assembly disposed intermediate the fan and the turbine and cooled by turbine outlet air. The compressor rotor and the turbine rotor are disposed in back to back relationship on opposite sides of a central plate with the turbine inboard of the compressor. The central plate disposed between the turbine and compressor rotors forms part of the housing encasing the turbine and compressor rotors and defining separate inlet and outlet ducts for the turbine rotor and the compressor rotor. In this arrangement, the central plate is exposed on its outboard side to relatively warmer air being ducted from the compressor rotor and is simultaneously exposed on its inboard side to relatively cooler air being ducted to the turbine rotor.

It is also known in the art for a single wheel to comprise a dual rotor, that is for a single wheel to provide two back-to-back rotors either formed integrally as one piece or integrally mounted together. For example, U.S. Pat. No. 4,312,191, discloses an air cycle machine including a dual rotor wheel mounted on a bearing assembly disposed about an axially extending shaft. This dual rotor wheel comprises a turbine disk and a compressor disk disposed in back-to-back relationship with the compressor disk integrally secured to the turbine disk. The dual rotor wheel is disposed within a housing defining the flow ducts to and from the compressor and turbine rotors and having a central annular plate portion which separates the turbine inlet flow duct from the compressor outlet flow duct. The central plate may be an integral part of the housing or formed by mating two housing segments together to encase the dual rotor wheel. In either case, the central plate is exposed on one side to relatively warmer air being ducted from the compressor rotor, while simultaneously being exposed on its other side to relatively cooler air being ducted to the turbine rotor.

On aircraft powered by turbine engines, the air to be conditioned in the air cycle machine is typically compressed air bled from one or more of the compressor stages of the turbine engine. In conventional systems, this bleed air is passed through the air cycle machine compressor wherein it is further compressed, thence passed through a condensing heat exchanger to cool the compressed air sufficiently to condense moisture therefrom thereby dehumidifying the air before expanding the dehumidified compressed air in the turbine of the air cycle machine to both extract energy from the compressed air so as to drive the shaft and also to cool the expanded turbine exhaust air before it is supplied to the cabin as conditioned cooling air.

The compressed bleed air being supplied to the compressor of the air cycle machine is typically supplied at a temperature of about 105° C. to about 120° C., but raised in temperature during the compression process to a temperature typically in the range about 150° C. to about 175° C. The temperature of the compressed air is thereafter reduced prior to being delivered to the turbine for expansion therein to a temperature typically in the range of about 40° C. to about 50° C. to dehumidify the air, and thence further cooled in the expansion process to a temperature typically less than 5 degrees Celsius above the freezing point of 0° C. Consequently, the temperature difference between the compressor outlet air and the turbine inlet air flowing on opposite sides of the central plate may range from 80 to 125 degrees Celsius.

In air cycle machines having separate compressor and turbine wheels disposed on a common rotor shaft in back-to-back relationship on opposite sides of a stationary central plate separating the compressor and turbine flow circuits, leakage of higher pressure air from the compressor outlet circuit into the lower pressure air flowing through the turbine inlet circuit can occur. Such leakage has an undesireable impact on air cycle machine performance as the consequent transfer of heat from the relatively warmer air flow leaking from the higher pressure compressor outlet air flow into and mixing with the relatively cooler air flow in the lower pressure turbine inlet circuit reduces the effective cooling efficiency of the expansion process. Since cooling the air flow is the primary function of the expansion turbine, this undesireable leakage of heat into the cooler turbine inlet air flow detracts from the attractiveness of such a back-to-back arrangement, which is generally otherwise desireable as a means of minimizing the overall length, and therefore weight, of the air cycle machine.

DISCLOSURE OF INVENTION

It is an object of the present invention to provide an air cycle machine having back-to-back compressor and turbine rotors wherein a combined sealing and venting arrangement is provided for limiting the leakage of the relatively warmer compressor outlet air flow into the relatively cooler turbine inlet air flow.

It is an additional object of a particular embodiment of the present invention to provide an air cycle machine having back-to-back compressor and turbine rotors incorporating a sealing arrangement comprising a pair of spaced knife edge seals extending outwardly from the rotor shaft intermediate the turbine and compressor rotors and contacting in sealing relationship a seal land mounted to the inboard end of a stationary central member disposed between the turbine and compressor rotors.

It is a further object of a specific embodiment of the present invention to provide an air cycle machine incorporating a plurality of vent holes disposed intermediate the spaced knife edge seals for venting a limited flow of compressor outlet air and/or turbine inlet air flow leaking past the seals to a low pressure region.

The air cycle machine of the present invention comprises a turbine rotor and a compressor rotor disposed in back-to-back relationship on a common shaft means for rotation therewith about a longitudinal axis and encased in a housing defining a turbine flow circuit and a compressor flow circuit, a stationary central member, such as an annular disk-like member, disposed coaxially about the shaft means and extending between the turbine and compressor rotors, and means for limiting the leakage of relatively warmer, higher pressure compressor outlet air into the relatively cooler, lower pressure turbine inlet air flow comprising sealing and venting means operatively disposed about the shaft means intermediate the turbine and compressors and in sealing relationship between the shaft means and the stationary central member.

In a particularly advantageous embodiment of the present invention, the sealing and venting arrangement comprises two sets of knife edge elements extending outwardly from the shaft means in spaced relationship intermediate the turbine rotor and the compressor rotor, seal land means mounted to the radially inboard end of the annular disk-like central member in sealing relationship with each set of knife edge elements, and vent hole means disposed between the spaced sets of knife edge elements. The vent hole means may comprise a plurality holes provided in the shaft means opening to a low pressure interior region thereof or a plurality of holes provided in the stationary central member opening therethrough to an external low pressure region. In either case, a small amount of compressor outlet air flow is deliberately passed through a first volume formed between the backside of the compressor rotor and an inboard root portion of the central member to leak past one of the knife edge seals and through the vent hole means, while at the same time a small amount of turbine inlet air flow is deliberately passed through a second volume formed between the backside of the turbine rotor and the root portion of the central member to leak past the other of the knife edge seals and through the vent hole means.

The compressor air flow leaking past the knife edge seal will be desireably vented through the vent hole means to a low pressure region rather than passing into the turbine inlet circuit, thereby avoiding mixing of the warmer compressor outlet air flow with the cooler air flow passing into the turbine. Additionally, as the region between the spaced seals and upstream of the vent hole means will be maintained at a pressure between that of the compressor outlet air flow and that of the low pressure region, the leakage of turbine inlet air flow through the venting circuit will be desireably limited.

BRIEF DESCRIPTION OF DRAWING

These and other objects, features and advantages of the present invention will become more apparent in light of the detailed description of the embodiment thereof illustrated in the accompanying drawing, wherein.

BEST MODE FOR CARRYING OUT THE INVENTION

Figure 1:
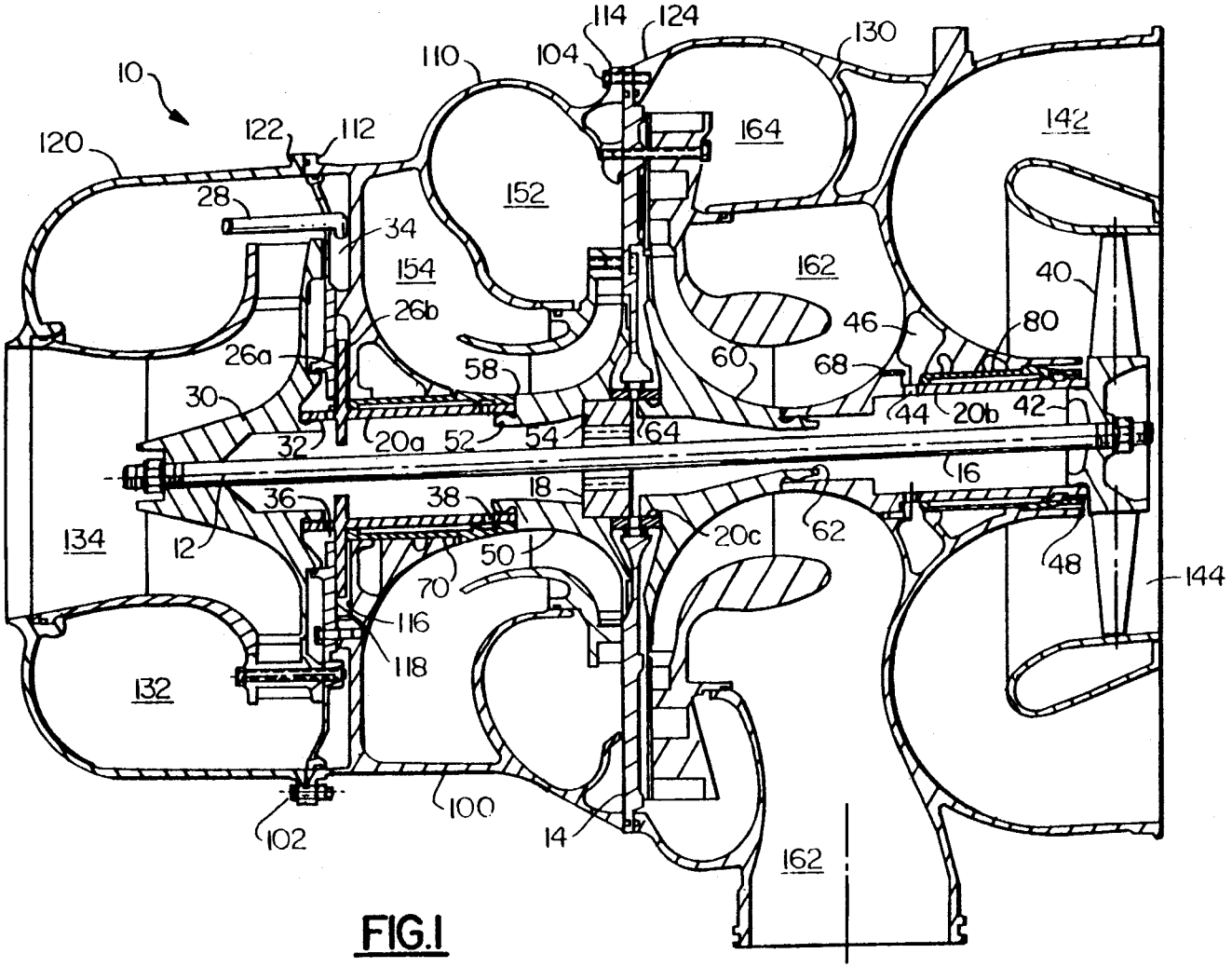
FIG. 1 is a side elevational view, partly in section, of a four wheel air cycle machine incorporating the present invention.

Referring now to FIG. 1, there is depicted therein an air cycle machine 10 having four distinct wheels coaxially disposed along a common shaft means 20 for rotation about a common longitudinal axis 12. A first wheel 30 is mounted to a first end portion 20*a* of the shaft means 20 for rotation therewith, a second wheel 40 is mounted to a second end portion 20*b* of the shaft means 20 for rotation therewith, a third wheel 50 is mounted to a central portion 20*c* of the shaft means 20 in spaced relationship from the first wheel 30 and the second wheel 40 for rotation therewith, and a fourth wheel 60 is also mounted to the central portion 20*c* of the shaft means 20 for rotation therewith in back-to-back relationship with the third wheel 50 and between the second wheel 40 and the third wheel 50. The shaft means 20 is supported for rotation about the longitudinal axis 12 on a pair of spaced bearing means 70 and 80 supported in a housing 100 which serves not only to support the bearing means, but also to provide appropriate inlet ducts and outlet ducts for the supply of working fluid to and the discharge of working fluid from each of the four wheels.

In the air cycle machine 10 embodying the present invention, one of the two wheels mounted to the central portion 20*c* of the shaft means 20, that is either the third wheel 50 or the fourth wheel 60, comprises a compressor rotor operative to compress a flow of gaseous working fluid and the other of the central wheels comprises a turbine rotor operative to expand the gaseous working fluid compressed via the compressor rotor thereby extracting energy therefrom so as to drive the shaft means 20 in rotation about the axis 12 and thereby power the compressor rotor. The two outer wheels, that is the first wheel 30 and the second wheel 40, may each comprise a fan rotor, or one may comprise an additional turbine rotor and the other a fan rotor, or one may comprise an additional turbine rotor and the other an additional compressor rotor, as desired. In fact, the wheels of an air cycle machine embodying the present invention may comprise any rotor combination having at least one turbine rotor and at least one compressor rotor wherein the turbine rotor and the compressor rotor are mounted on a common shaft in back-to-back relationship, with the turbine rotor extracting sufficient energy from the gaseous working fluid expanded therein to drive the shaft means 20, and the compressor rotor, and any other rotor or rotors, as the case may be, mounted on the common shaft means 20 in rotation therewith about the axis 12.

Each of the shaft members 20*a*, 20*b* and 20*c* comprise an annular sleeve defining an open ended hollow central cavity. The end shaft members 20*a* and 20*b* are supported for rotation about the longitudinal axis 12 on bearing means 70 and 80, respectively. Each of the four wheels 30, 40, 50 and 60 is a rotor comprising a hub portion and a plurality of rotor blades extending outwardly from the hub portion. The hub portion of each rotor has a central opening extending axially therethrough to accommodate an elongated tie rod 16 extending along the longitudinal axis 12 through the central axial openings in the four wheels and through the hollow cavities of the shaft members. The tie rod 16 is bolted up at its ends to the outer wheels 30, 40 to axially clamp the four wheels and the shaft members together with sufficient axial clamping load that all four wheels and all shaft members rotate together as one integral wheel and shaft assembly.

The first end wheel 30 is mounted to the outboard end of the first end shaft member 20*a* and the second end wheel 40 is mounted to the outboard end of the second end shaft member 20*b*. The central wheel 50 is mounted to the inboard end of the first end shaft member 20*a* and the central wheel 60 is mounted to the second end shaft member 20*b*. The two central wheels 50 and 60 are additionally mounted to the central shaft member 20*c* for rotation therewith and disposed in back to back relationship on opposite sides of an annular disc-like member 14 having a central opening circumscribing the central shaft member 20*c* and extending radially outwardly therefrom. Each of the wheels 30, 40, 50 and 60 is mounted to its respective end shaft member 20*a*, 20*b* by an interference fit between a piloting rim 32, 42, 52, 62, respectively, extending axially outwardly from the wheel hub, and the inner wall of the shaft member bounding the central cavity thereof into which cavity the rim is precisely piloted, thereby ensuring that the wheels and the shaft members rotate together about the axis 12.

Figure 2:
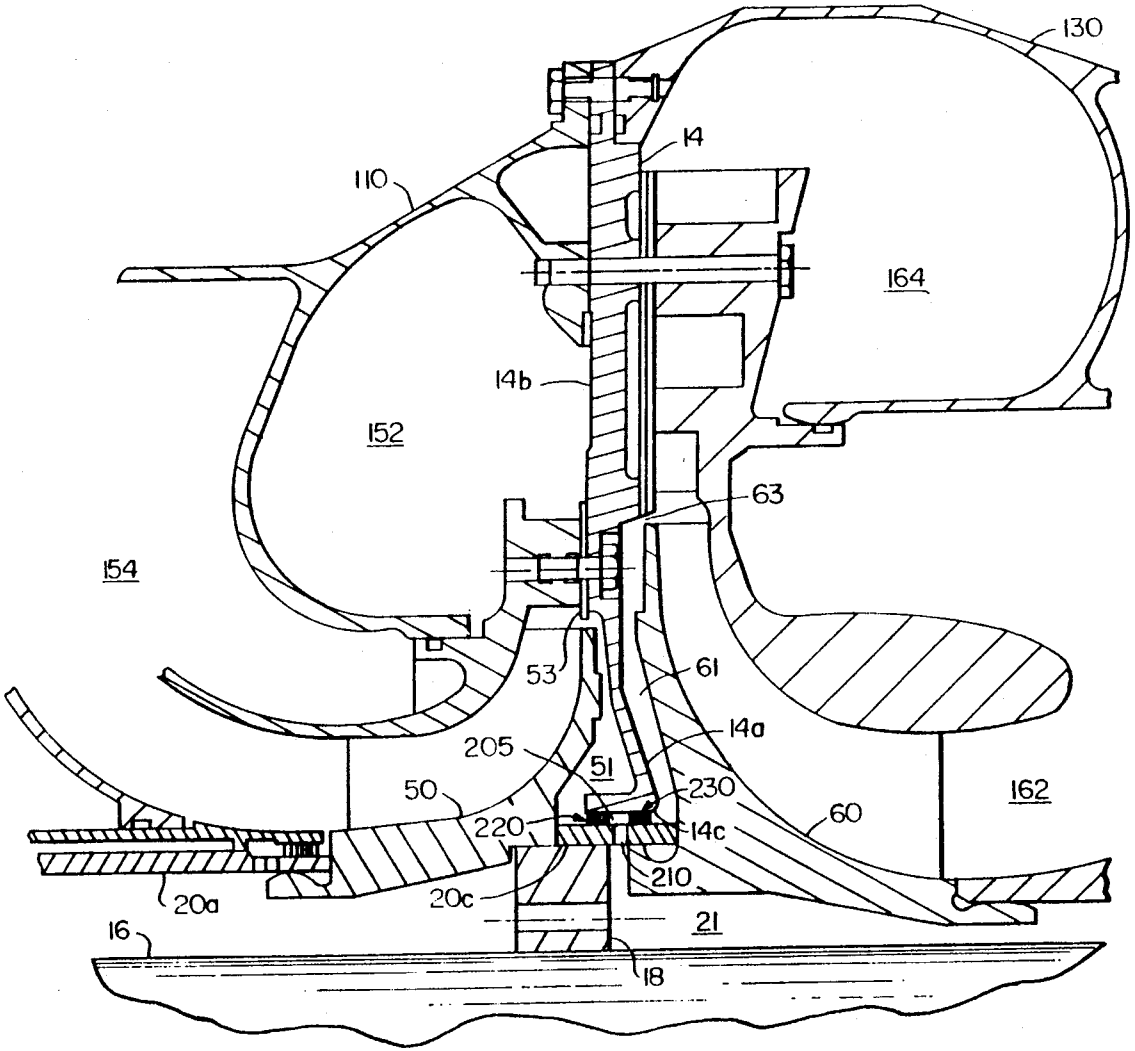
FIG. 2 is an enlarged side elevational view, partly in section, of the region 2—2 of the embodiment of the present invention illustrated in FIG. 1.

Alternate methods of mounting the wheels to the shaft members be may used in constructing the air cycle machine 10. For example, as best seen in FIG. 2, the third wheel 50 is not mounted to the central shaft member 20*c* by means of a piloting rim, but rather is mounted to the central shaft member 20*c* through a pilot bushing 18 coaxially disposed about the axis 12. The hub of the third wheel 50 has a central piloting socket 54 sized to receive and retain by interference fit one end of the pilot bushing 18. The other end of the pilot bushing 18 is received into one end of the central cavity of the central shaft member 20*c* and retained therein by interference fit with the inner wall of the central shaft member 20*c*. The fourth wheel 60 is mounted to the central shaft member 20*c* through a piloting rim 64 which is received into the other end of the central cavity of the central shaft member 20*c* and retained therein by interference fit with the inner wall thereof. The four wheels and the three shaft members to which they are so mounted are axially loaded together by the tie rod 16 extending coaxially therethrough, thereby ensuring that the four wheels and the three shaft members rotate together about the longitudinal axis 12 as a single assembly. The pilot bushing 18 also serves to center the entire wheel and shaft assembly coaxially about the tie rod 16.

The wheel and shaft assembly is disposed within a housing 100 which provides individual inlet and outlet ducts for each of the rotors and also provides support for the bearing means 70 and 80. The housing 100 may advantageously be comprised of two or more sections to facilitate assembly. The bearing means 70 and 80 radially supporting the shaft and wheel assembly for rotation about the longitudinal axis 12 may comprise hydrodynamic journal bearings, such as for example gas film foil journal bearings of the type disclosed in commonly assigned U.S. Pat. Nos. 4,133,585; 4,247,155; and/or 4,295,689. The hydrodynamic journal bearing 70 is disposed about the first end shaft member 20*a* between the first wheel 30 and the third wheel 50, and the hydrodynamic journal bearing 80 is disposed about the second end shaft member 20*b* between the second wheel 40 and the fourth wheel 60. Each of the hydrodynamic bearings 70 and 80 comprises an inner race mounted to its respective shaft member, an outer race disposed coaxially about the inner race in radially spaced relationship therefrom and supported in the housing 100 to restrict axial or rotational displacement of the outer race, and a foil pack disposed in an annular space formed between the radially spaced inner and outer races through which pressurized air is passed to provide the appropriate hydrodynamic forces necessary for the journal bearings 70 and 80 to support the shaft and wheel assembly for rotation about longitudinal axis 12.

Additionally, a hydrodynamic thrust bearing 26 is provided for axially supporting the shaft and wheel assembly of the air cycle machine 10. The hydrodynamic thrust bearing may comprise a gas film foil thrust bearing, such as for example of the type disclosed in commonly assigned U.S. Pat. Nos. 4,082,325; 4,116,503; 4,247,155 and/or 4,462,700. The bearing 26 includes an outboard bearing member 26*a* and an inboard bearing member 26*b* operatively disposed on opposite sides of a thrust disc 90 extending outwardly from the first end shaft member 20*a* intermediate an end wall 116 of the central housing section 110 and a bearing plate 118 disposed between the central housing section 110 and the first end section 120 inboard of the outboard first wheel 30.

In the air cycle machine 10 as illustrated in the drawing, the central third wheel 50 comprises a first stage turbine rotor, the central fourth wheel 60 comprises a compressor rotor, the outboard first wheel 30 comprises a second stage turbine rotor, and the outboard second wheel 40 comprises a fan rotor. The first and second stage turbine rotors 30 and 50 serve not only to expand and cool the air being conditioned, but also extract energy from the air being expanded for rotating the entire wheel and shaft assembly so to drive the fan rotor 40 and the compressor rotor 60. This embodiment of the air cycle machine 10 is particularly suited for use in a condensing cycle air conditioning and temperature control system for cooling and dehumidifying air for supply to an enclosure for occupant comfort, such as the condensing cycle environmental control system for supplying cooled and dehumidified air to the cabin of an aircraft as disclosed in commonly assigned, U.S. Pat. No. 5,086,022, co-pending application serial no. filed Aug. 17, 1990, which is hereby incorporated by reference.

In the illustrated embodiment of the air cycle machine 10, the housing 100 is comprised of three sections: a central section 110 surrounding the turbine rotor 50 and providing a first stage turbine inlet duct 152 circumscribing the turbine rotor 50 radially outwardly thereof for supplying air to the turbine rotor 50 to be expanded therein and providing a first stage turbine outlet duct 154 axially adjacent the outlet of the turbine rotor 50 for discharging the exhaust air expanded in the turbine rotor 50, a first end section 120 surrounding the turbine rotor 30 and providing a second stage turbine inlet duct 132 for supplying air to the turbine rotor 30 to be expanded therein and an axially directed second stage turbine outlet duct 134 for discharging the exhaust air expanded in the turbine rotor 30, and a second end section 130 surrounding both the compressor rotor 60 and the fan rotor 40 and providing an inlet duct 162 axially adjacent the inlet to the compressor rotor 60 for supplying air to the compressor rotor 60 to be compressed therein, an outlet duct 164 circumscribing the compressor rotor 60 radially outwardly thereof for discharging air compressed via the compressor rotor 60, an inlet duct 142 for directing ram cooling air to the fan rotor 40 and an axially directed outlet duct 144 for discharging ram cooling air having passed through the fan rotor 40. The central housing section 110 is mounted at one of its ends to the first end housing section 120 by a plurality of circumferentially spaced bolts 102 attaching a flange 112 of the central section 110 to a flange 122 of the end section 120, and at its other end to the second end housing section 130 by a plurality of circumferentially spaced bolts 104 passing through the annular disc-like member 14 to attach flange 114 of the central section 110 to flange 124 of the end section 130.

To cool and pressurize the thrust bearing 26 and the journal bearings 70 and 80 during operation, relatively cool, pressurized air from the second stage turbine inlet duct 132 is passed through a flow tube 28 into an annular chamber 34 located between the bearing plate 118 and the end wall 116. A first portion of this cool pressurized air flows therefrom through the outboard thrust bearing member **26*a* to pressurize and cool this bearing member and thence through openings 36 in the outboard end portion of the first end shaft member 20*a* into the hollow interior cavity 21 thereof. A second portion of this cool pressurized air flows from the chamber 34 through the inboard thrust bearing member 26*b* and thence through the first journal bearing 70 to cool and pressurize both of these hydrodynamic bearings. After traversing the first journal bearing 70, this second portion of the cool pressurized air passes through openings 38 in the inboard end portion of the first end shaft member 20*a* into the hollow interior cavity 21 thereof to remix with the first passes through the hollow interior of the shaft and wheel assembly to pass through openings 44 in the inboard end portion of the second end shaft member 20*b* to enter a chamber 46 from which this cool pressurized air passes through the second journal bearing 80, thereby cooling and pressuring the second hydrodynamic journal bearing 80, before exiting past a seal 48, such as a labyrinth seal, into the duct 142. Additional seals 58 and 68, also depicted as labyrinth seals, are provided to prevent the bearing cooling and pressurizing air from escaping the bearing flow circuit. Seal 58, which is disposed between the inboard end portion of the first end shaft member 20*a* and the inboard end of the first journal bearing 70, allows a limited flow of higher pressure, cool air from the first stage turbine outlet duct 154 to leak into the bearing flow circuit thus sealing the first journal bearing 70, and seal 68, which is disposed between the inboard end portion of the second end shaft member 20*b* and the surrounding housing, allows a limited flow of higher pressure, relatively cool air to leak from the compressor inlet duct 162 into the chamber 46 thereby sealing the second journal bearing 80**.

Figure 3:
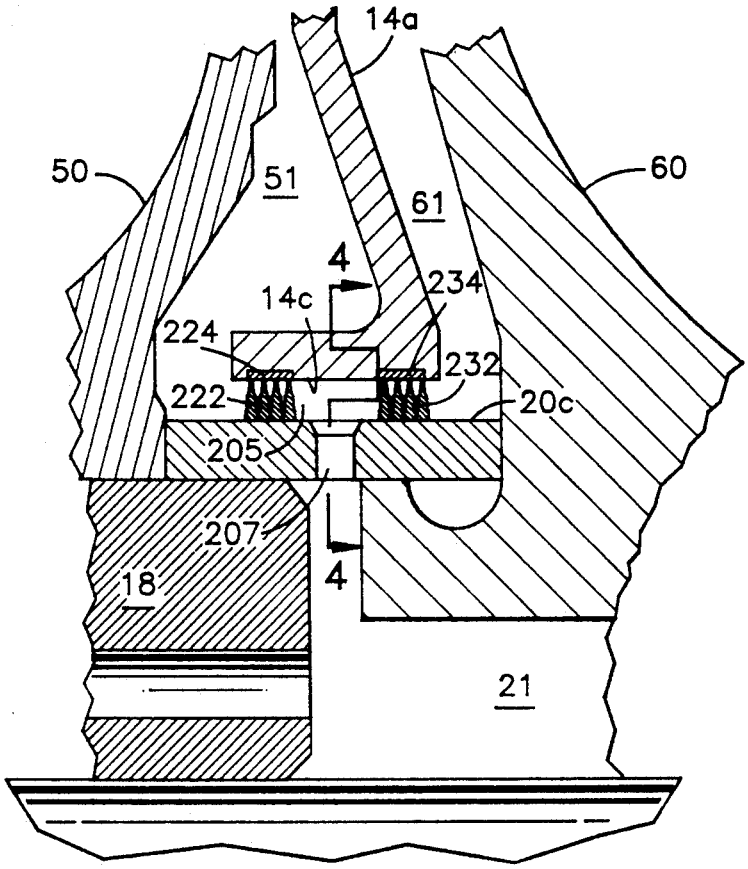
FIG. 3 is a further enlarged, sectioned, side elevational view of region 3—3 of the embodiment of the present invention illustrated in FIG. 2.

Referring now particularly to FIGS. 2 and 3, the central member comprises a stationary annular disc-like member 14 disposed coaxially about the central shaft member **20*c* and extending therefrom radially outwardly such that a radially inward root portion 14*a* thereof is disposed between the backside of the compressor rotor 60 and the backside of the turbine rotor 50 and a radially outer portion 14*b* of the annular disk-like member is disposed between the central housing section 110 and the second housing section 130 to separate the air flow circuit associated with the compressor rotor 60 from the air flow circuit associated with the turbine rotor 50 over at least a substantial part of their extent, preferably so as to extend between and separate between the inlet duct 152 of the turbine flow circuit and the outlet duct 164 of the compressor flow circuit. The annular disk-like member 14 is disposed about the cylindrical central shaft sleeve 14*c* with its radially inward rim surface 14*c* spaced radially outwardly therefrom so as to circumscribe the shaft sleeve 20*c* at a radial spacing therefrom thereby defining an annular space therebetween. Advantageously, the radially inward root portion 14*a*of the annular disk-like member 14 separating the back-to-back rotors 50 and 60 is disposed therebetween in spaced relationship with both the turbine rotor 50 and the compressor rotor 60 so as to provide a first volume 61 between member 14 and the backside of the compressor rotor 60 which is open to the compressor outlet duct 164 through a relatively small annular passage 63 and to provide an second volume 51 between member 14 and the backside of the turbine rotor 50 which is open to the turbine inlet duct 152 through a relatively small annular passage 53**.

In accordance with the present invention, sealing and venting means 200 is operatively disposed about the central shaft member **20*c* at a location intermediate the turbine rotor 50 and the compressor rotor 60 for establishing a sealing relationship between the outer surface of the central shaft 20*c* of the shaft means 20 and the radially inward annular rim surface 14*c* of the annular disc-like member 14 disposed about the central shaft member 20*c* between the turbine rotor 50 and the compressor rotor 60. The sealing and venting means 200 comprises vent means 210 and a pair of seal means 220 and 230 disposed in axially spaced relationship along the central shaft member 20*c* so as to define an annular volume 205 between the annular disk-like member 14 and the central shaft member 20*c*, which is bounded radially outwardly by the inward annular rim surface 14*c* of the annular disc-like member 14 and radially inwardly by the outer surface of the cylindrical central shaft sleeve 20*c*, and axially by the first seal means 220 at one end and the second seal means 230 at the other end. Vent means 210 opens to the annular volume 205 defined between the axially spaced seal means 220 and 230 for venting air flow leaking into the annular volume 205 to a low pressure region as will be discussed in more detail hereinafter. The first seal means 220 functions to limit the flow of turbine inlet air leaking into the annular volume 205 and the second seal means 230 functions to limit the flow of compressor outlet air leaking into the annular volume 205. The annular volume 205 is vented via vent means 210 to a region maintained at a pressure which is lower than both the pressure of the turbine inlet air in the annular volume 51 on the backside of the turbine rotor 50, termed the turbine backside pressure, and the pressure of the compressor outlet air in the annular volume 61 on the backside of the compressor rotor 60, termed the compressor backside pressure. Therefore, the pressure within the annular volume 205 is maintained at a pressure between the low pressure of the region to which the vent means 210 opens and the higher pressure of the turbine inlet air and the compressor outlet air upstream of the seal means 220 and 230**, respectively.

Figure 4:
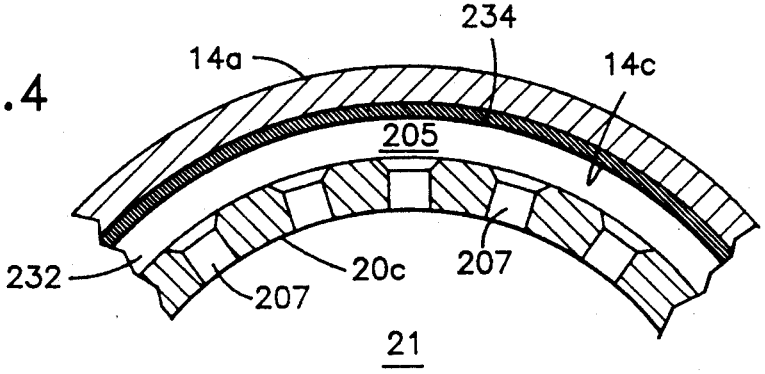
FIG. 4 is a cross-sectional view taken along 4—4 of FIG. 3.

Advantageously, each of the first seal means 220 and second seal means 230 comprises a set of knife edge elements 222 and 232, respectively, extending radially outwardly from and circumferentially about the cylindrical central shaft sleeve 20*c* and a seal land 224 and 234, respectively, mounted to and extending circumferentially about the inward rim surface 14*c* of the annular disk-like member 14 in sealing relationship with the knife like edge elements 222 and 232, respectively, to form a labyrinth-like seal. The vent means 210 may comprise a plurality of holes 207 disposed at circumferentially spaced intervals about and extending through the central shaft sleeve 14*c* to open to a low pressure interior region 21 defined within the hollow shaft means 20, as illustrated in FIGS. 3 and 4. Alternatively, the vent means 205 could comprise a plurality of holes provided in the stationary annular disk-like member 14 and opening therethrough to an external low pressure region.

In either case, during operation of the air cycle machine 10 a limited small amount of compressor outlet air flow passes from the compressor outlet duct 164 through the annular opening 63 into the first volume 61 formed between the backside of the compressor rotor 60 and the root portion 14*a* of the annular disc-like member 14 and thence leaks past the knife edge seal means 230 and through the holes 207 forming the vent means 205 into the interior 21 of the hollow shaft means 20. At the same time, a limited small amount of turbine inlet air flow passes from the turbine inlet duct 152 through the opening 53 into the second volume 51 formed between the backside of the turbine rotor 50 and the root portion 14*a* of the annular disk-like member 14 and thence leaks past the knife edge seal means 222 and through the holes 207 forming the vent means 210 into the interior 21 of the hollow shaft means 20. Therein, the vented air flows mix with the bearing air flow passing through the interior of the shaft means and passes through the second journal bearing 80 before exiting through seal 48 into the fan inlet duct 142.

Thus, the compressor air flow leaking past the knife edge seal means 230 will be desireably vented through the vent means 210 to a low pressure region, which in the illustrated embodiment is the interior of the shaft means 20, rather than passing into the turbine inlet duct 152, thereby avoiding mixing of the warmer compressor outlet air flow with the cooler air flow passing into the turbine. Additionally, by suitably sizing the holes 207 forming the vent means 210, the annular volume 205 between the spaced seal means 220 and 230 and upstream of the vent means 210 may be maintained at a pressure between that of the compressor outlet air flow and that of the relatively low pressure region within the hollow shaft means 20. By careful selection of the vent hole size for a particular design condition, the pressure within the annular volume 205 may be made equal or about equal to the turbine backface pressure, i.e. the pressure within the second volume 51, thereby ensuring that leakage of turbine inlet air flow through the venting circuit will be desireably minimized.

As disclosed in commonly assigned co-pending application Ser. No. 07/819412, filed of even date, the annular disk-like member 14 may advantageously comprise a relatively poor heat conducting member whereby heat transfer across the annular disk-like member 14 from the relatively warmer fluid passing into and out of the compressor rotor 60 to the relatively cooler fluid passing into and out of the turbine rotor 50 is retarded. By relatively poor heat conducting member it is meant that the annular disk-like member 14 has a thermal conductivity which is at least about an order of magnitude lower than the thermal conductivity of conventional metals, typically aluminum, from which aircraft air cycle machine components are made. Additionally, to reduce heat transfer from the compressor rotor per se to the turbine rotor per se through the central shaft sleeve 20*c* to which both the compressor and turbine rotors are mounted, the central shaft sleeve 20*c* may comprise a relatively thin walled, elongated sleeve made of a structural steel alloy having a thermal conductivity lower than the thermal conductivity of the material from which the rotors are made, which is typically aluminum. In the depicted embodiment of the air cycle machine 10, the pressure differential imposed across the radially outward portion 14*b* of annular disk-like member 14 is advantageously minimized since the pressure of the air flow in the turbine inlet duct 152 is only slightly less than the pressure of the air flow in the compressor outlet duct 164, typically by only a few psi due to pressure losses experienced as the air flow traverses the flow conduits (not shown) from the compressor outlet duct 164 to the turbine inlet duct 152 and an intermediate heat exchanger (not shown) disposed therebetween. The pressure differential across the radially inward root portion 14*a* of the annular disk-like member 14 separating the back-to-back rotors 50 and 60 is also minimized as the compressor backside pressure in the first volume 61 and the compressor backside pressure in the second volume 51 are also relatively equal.

As the pressure differential across the annular disk-like member 14 is maintained relatively low over its entire extent via the aforementioned construction, the annular disk-like member 14 may be made from a relatively low strength, low thermal conductivity, insulating material, such as a non-metallic composite or ceramic material. Thus, the annular disk-like member 14 may advantageously be formed of a fiber reinforced, thermosetting resin material, such as an epoxy, polyimide or like resin matrix reinforced with fiberglass, graphite, aramid or like fibers, with the resin selected to give the desired low thermal conductivity and the fiber selected to give the required strength. For example, the annular disk-like member 14 may comprise a body of a polyimide resin matrix, such as HyComp-M310 resin from Dexter Composites, reinforced with graphite fibers to improve strength.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

We claim:

1. An air cycle machine for conditioning air for supply to an enclosure, said air cycle machine comprising:

shaft means supported for rotation about a longitudinally extending axis;

a compressor wheel mounted to said shaft means for rotation therewith for compressing air delivered thereto;

a turbine wheel mounted to said shaft means for expanding compressed air from said compressor wheel thereby extracting energy to drive said shaft means in rotation about the axis, said turbine wheel and said compressor wheel disposed in back-to-back relationship;

a stationary annular disk-like member disposed coaxially about said shaft means and extending radially outwardly between said turbine wheel and said compressor wheel, said annular disk-like member having a radially inward portion having an inward rim surface circumscribing said shaft means at a radial spacing therefrom thereby defining an annular space between said shaft means and said annular disk-like member;

a turbine inlet duct circumscribing said turbine rotor for directing a flow of relatively cooler relatively high pressure air into said turbine rotor to be expanded in said turbine;

a compressor outlet duct circumscribing said compressor rotor for discharging a flow of relatively warmer relatively high pressure air passing out of said compressor;

means for venting the annular space defined between said shaft means and said annular disk-like member to a low pressure region; and means for sealing the annular space defined between said shaft means and said annular disk-like member from the turbine inlet duct and from the compressor outlet duct whereby a limited flow of turbine inlet air and a limited flow of compressor outlet air leaks pass said sealing means into the annular space defined between said shaft means and said annular disk-like member and thence through said vent means into the low pressure region.

2. An air cycle machine as recited in claim 1 wherein said vent means comprises a plurality of holes extending through said shaft means and disposed at circumferentially spaced intervals about said shaft means, each hole providing a flow passageway between the annular space and a low pressure interior cavity of said shaft means.

3. An air cycle machine as recited in claim 2 wherein said holes are selectively sized to limit the flow into the low pressure region whereby the annular volume is maintain at a pressure about equal to the pressure of the flow of turbine inlet air that leaks pass said sealing means into the annular space.

* * * * *